US006964353B1

(12) United States Patent
Lamerson

(10) Patent No.: US 6,964,353 B1
(45) Date of Patent: Nov. 15, 2005

(54) DE-ICING MATERIAL DISPENSING SYSTEM FOR GUTTERS

(76) Inventor: Michael R. Lamerson, 6900 Moccason St., Westland, MI (US) 48185-2809

( * ) Notice: Subject to any disclaimer, the term of this patent is extended or adjusted under 35 U.S.C. 154(b) by 0 days.

(21) Appl. No.: 10/815,080

(22) Filed: Apr. 1, 2004

(51) Int. Cl.[7] ..... B67D 5/64
(52) U.S. Cl. ..... 222/174; 222/191; 222/517; 222/565
(58) Field of Search ..... 222/174, 191, 222/196, 346, 517, 565

(56) References Cited

U.S. PATENT DOCUMENTS

| | | | | |
|---|---|---|---|---|
| 277,555 | A * | 5/1883 | Erlenborn | 222/166 |
| 370,004 | A * | 9/1887 | Bruner | 222/166 |
| 1,226,443 | A * | 5/1917 | Baker | 239/280 |
| 3,145,880 | A * | 8/1964 | Whatley | 222/196.4 |
| 4,769,526 | A | 9/1988 | Taouil | |
| 5,391,858 | A | 2/1995 | Tourangeau et al. | |
| 5,786,563 | A | 7/1998 | Tiburzi | |
| 5,878,533 | A | 3/1999 | Swanfeld, Jr. | |
| 6,314,685 | B1 | 11/2001 | Sullivan | |
| 6,348,673 | B2 | 2/2002 | Winters | |
| 6,450,423 | B1 * | 9/2002 | Gurule | 239/531 |
| 6,489,594 | B2 | 12/2002 | Jones | |
| 2004/0256412 | A1 * | 12/2004 | Meyer | 222/174 |

* cited by examiner

*Primary Examiner*—Joseph A. Kaufman
(74) *Attorney, Agent, or Firm*—John D. Gugliotta

(57) ABSTRACT

An apparatus for dispensing ice melting chemicals directly into roof gutters comprises a linearly elongated pole having two cushioned grips for comfortable holding. At the upper end of the pole, a guide hook is provided which hooks over the edge of the gutter, and properly positions a container filled with calcium chloride or other safe ice-melting chemical directly over the gutter. A lever at the bottom handle opens a release gate on the chemical container allowing a small amount of the chemical to be released into the gutter. Should the chemical clog and not be released, a separate hammer may be activated by a hammer lever to tap the chemical container and aid in the chemical release. The user would release approximately eight to twelve ounces of chemical every four to five feet along the gutter to aid in ice melting.

11 Claims, 4 Drawing Sheets

DE-ICING MATERIAL DISPENSING SYSTEM FOR GUTTERS

RELATED APPLICATIONS

The present invention was first described in Disclosure Document Number 539,592 filed on Oct. 7, 2003 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to deicing systems, and, more particularly, to a deicing material dispensing system for gutters.

2. Description of the Related Art

Those of us who live in areas where the winter climate brings snow, sleet, high winds and ice know all too well of the harshness and hazards associated with such weather. Such conditions are not only hard on people, but buildings as well. Perhaps the biggest threat to homes in such climates is the ice that builds up in roof gutters. The massive ice damns that buildup with repeated thawing and freezing cycles not only risk damaging the gutter, but the roof and possibly the structural frame of the home as well in severe situations. Such severe weather conditions make it impossible to climb onto the roof to work on the ice damns. Ladders are hardly any safer when snow and ice builds up on the steps, exposing the user to severe and nasty falls.

A search of the prior art did not disclose any patents that read directly on the claims of the instant invention; however, the following references were considered related:

| U.S. Pat. No. | Inventor | Issue Date |
|---|---|---|
| 5,391,858 | Tourangeau et al. | Feb. 21, 1995 |
| 5,878,533 | Swanfeld, Jr. | Mar. 9, 1999 |
| 5,786,563 | Tiburzi | Jul. 28, 1998 |
| 6,314,685 | Sullivan | Nov. 13, 2001 |
| 6,348,673 | Winters | Feb. 19, 2002 |
| 6,489,594 | Jones | Dec. 3, 2002 |
| 4,769,526 | Taouil | Sep. 6, 1988 |

Consequently, a need has been felt for providing a means by which ice buildup in roof gutters can be safely eliminated without the disadvantages listed above.

SUMMARY OF THE INVENTION

It is therefore an object of the present invention to provide an improved deicing system.

It is a feature of the present invention to provide an improved deicing material dispensing system for gutters.

Briefly described according to one embodiment of the present invention, the de-icing dispenser for gutters is an apparatus for dispensing ice melting chemicals directly into roof gutters, while allowing the user to remain safe on ground level. The dispenser includes a long handle which will allow a user of average height to reach the gutters while safely standing on the ground. The angle of the handle with respect to the ground will be approximately 45°. The handle is provided with two cushioned grips for comfortable holding. At the upper end of the invention, a guide hook is provided which hooks over the edge of the gutter, and properly positions a container filled with calcium chloride or other safe ice-melting chemical directly over the gutter. A trigger release mechanism at the bottom handle opens a release gate on the chemical container allowing a small amount of the chemical to be released into the gutter. Should the chemical clog and not be released, a separate "thumping" mechanism will be activated by a lower handle and tap the chemical container to aid in the chemical release. The user would release approximately eight to twelve ounces of chemical every four to five feet along the gutter to aid in ice melting.

The use of the De-Icing Dispenser for Gutters allows homeowners to keep their gutters clear of ice in the winter time thus preventing possible costly roof and structural damage.

An advantage of the present invention is that it dispenses ice-melting chemical directly into roof gutters, thereby helping eliminate ice dams and blockage in roof gutters in the winter time.

Further, the present invention allows user of typical height to reach the gutters while safely standing on the ground.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| DESCRIPTIVE KEY | |
|---|---|
| 10 | deicing material dispensing system for gutters |
| 15 | user |
| 20 | building |
| 25 | roof gutters |
| 30 | grade level |
| 35 | deicing material |
| 40 | interval distance "d" |
| 45 | roof valley locations |
| 50 | down spout locations |
| 55 | pole |
| 60 | upper cushioned hand grip |
| 65 | lower cushioned hand grip |
| 70 | deicing material release lever |
| 72 | internal cable |
| 73 | pulleys |
| 75 | deicing material slide gate |
| 80 | deicing material reservoir |
| 85 | reservoir lid |
| 90 | aligning hook |
| 95 | support brace |
| 100 | outward edge of roof gutter |
| 105 | support arms |
| 110 | thumping mechanism |
| 115 | thumping lever |

-continued

| DESCRIPTIVE KEY | |
|---|---|
| 120 | pivot point |
| 125 | control cable |
| 130 | return spring |
| 135 | hole array |
| 140 | connecting harness |
| 145 | connecting cable |

DESCRIPTION OF THE PREFERRED EMBODIMENTS

The best mode for carrying out the invention is presented in terms of its preferred embodiment, herein depicted within the FIGS. 1–6.

1. Detailed Description of the Figures

Figure 1:
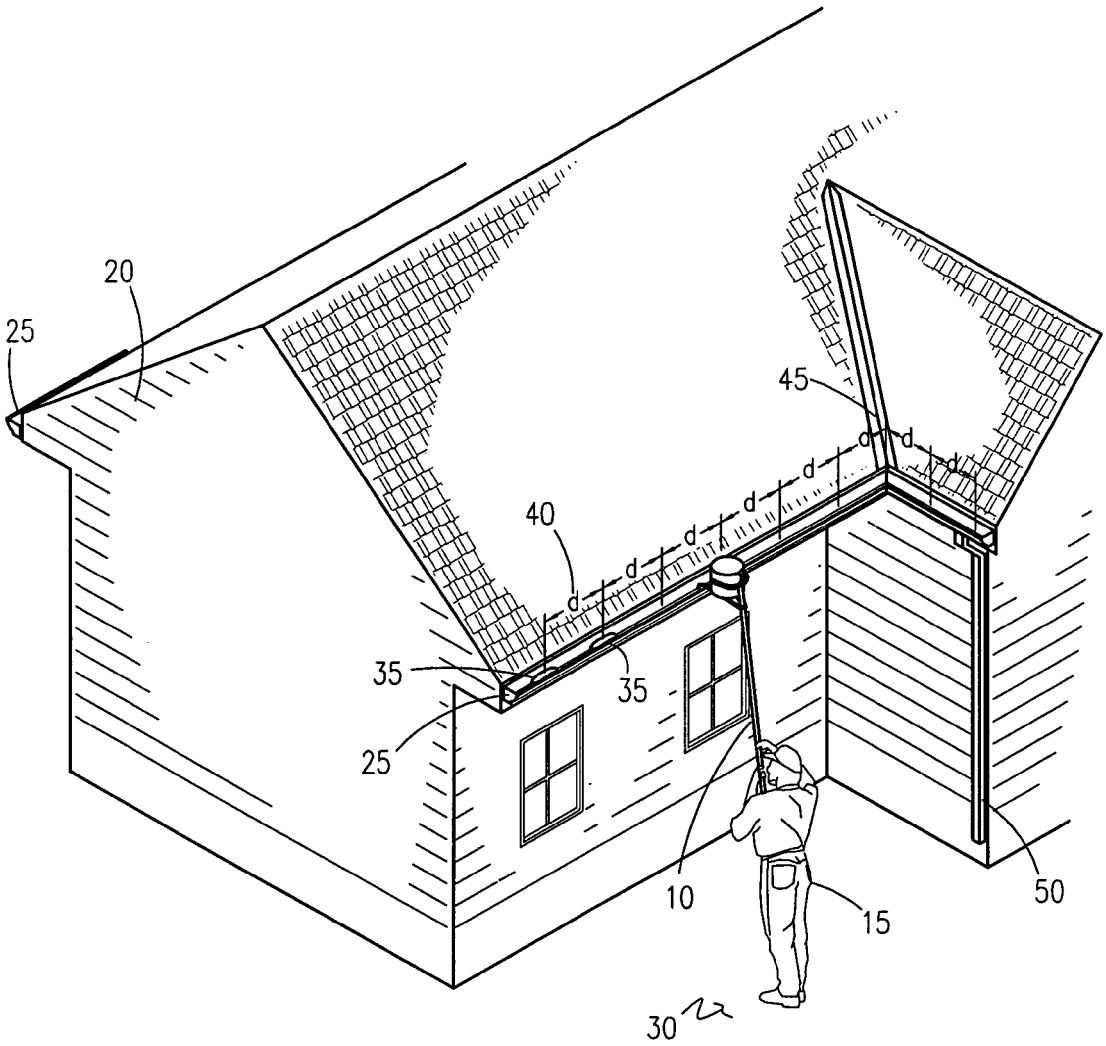
FIG. 1 is an overall pictorial diagram depicting the deicing material dispensing system for gutters 10 in a state of being utilized, according to a preferred embodiment of the present invention.

Referring now to FIG. 1, an overall pictorial diagram of the deicing material dispensing system or apparatus for gutters 10, in a state of utilization, is disclosed according to a preferred embodiment of the present invention. A user 15 stands along a building 20 such as a residential home or other single story structure equipped with roof gutters 25. It should be noted that while the current FIG. depicts a single story structure building 20, it is envisioned that the deicing material dispensing system for gutters 10 could be used with multiple story structures by the use of a longer deicing material dispensing system for gutters 10, and as such should not be interpreted as a limiting factor of the current invention. The user 15 is standing safely upon a grade level 30 as normally provided on the exterior of a building 20. As such, the user 15 is capable of walking along the grade level 30 for the length and travel path of the roof gutters 25. As will be described in greater detail herein below, the user 15 uses the deicing material dispensing system for gutters 10 to deposit a small amount of deicing material 35 in or on the roof gutters 25 proper at an interval defined by an interval distance "d" 40. It is envisioned that the amount of deicing material 35 dispensed would be approximately eight to twelve ounces and the interval distance "d" 40 would be approximately four to five feet, though amounts and distances could vary depending on the amount of ice buildup on the roof gutters, current weather conditions, type of deicing material 35 being used and the like. It is also envisioned that a continuous stream or path of deicing material 35 could be dispensed by the deicing material dispensing system for gutters 10 along the entire route of the roof gutters 25. Additional amounts of deicing material 35 could be dispensed in troublesome ice buildup locations such as roof valley locations 45, down spout locations 50, and the like.

Figure 2:
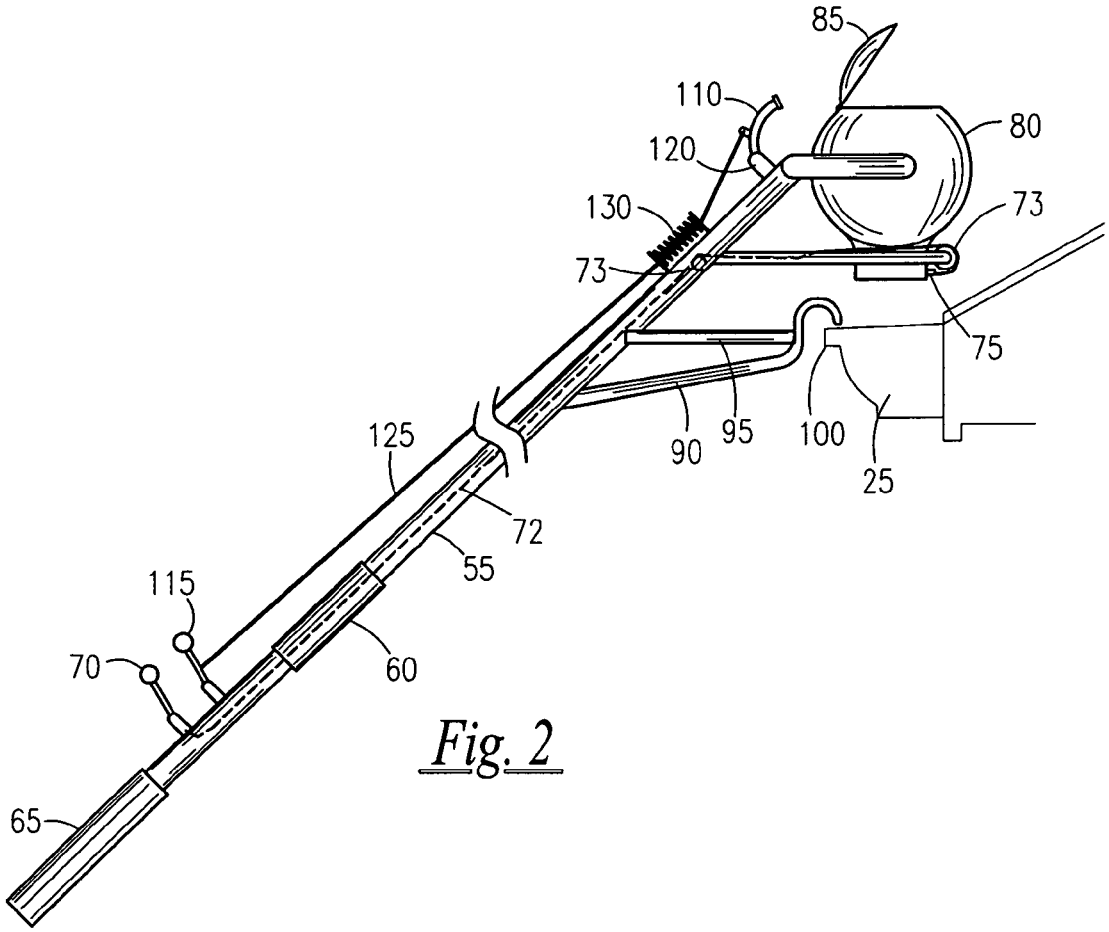
FIG. 2 is a side view of the deicing material dispensing system for gutters 10.

Referring next to FIG. 2, a side view of the deicing material dispensing system for gutters 10 is shown. The central component of the deicing material dispensing system for gutters 10 is a pole 55, which would vary in length depending on the distance of the roof gutters 25 (as shown in FIG. 1) above the grade level 30 (as shown in FIG. 1). The pole 55 is equipped with an upper cushioned hand grip 60 and a lower cushioned hand grip 65. The upper cushioned hand grip 60 would be held in the left hand and the lower cushioned hand grip 65 would be held in the right hand in the case of a right-handed user and vice-versa in the case of a left-handed user. The lower cushioned hand grip 65 is provided with a deicing material release lever 70 which when operated, activates an internal cable 72 (shown as dashed line for illustrative purposes) inside the pole 55 which opens a deicing material slide gate 75 at the top of the pole 55 under a deicing material reservoir 80 via the use of two pulleys 73. The deicing material reservoir 80 is of a sufficient size to contain approximately three to five pounds of deicing material 35 (as shown in FIG. 1). The deicing material reservoir 80 is equipped with a reservoir lid 85 to allow the user 15 (as shown in FIG. 1) to fill the deicing material reservoir 80. An aligning hook 90 supported by a support brace 95 allows for the proper and automatic positioning of the deicing material slide gate 75 over the roof gutters 25. The aligning hook 90 will be shown in greater detail herein below. The aligning hook 90 will rest upon the outward edge of roof gutter 100, thus assuring proper positioning. Such positioning is important to avoid dispensing deicing material 35 above or beyond the roof gutters 25 on the roof of the structure, or below the roof gutters 25 where it may fall upon the grade level 30 (as shown in FIG. 1) or possibly upon the user 15 (as shown in FIG. 1). The deicing material reservoir 80 is attached to the pole 55 by the use of two support arms 105, one of which is shown here for purposes of illustration. A thumping mechanism or hammer 110 is provided which is capable of tapping or "thumping" the side of the deicing material reservoir 80 should the deicing material 35 inside clump or stick together. Such a feature is important in the event that any moisture in the deicing material 35 is present, and environmental conditions such as temperature and humidity may cause it to clump or stick together. The thumping mechanism or hammer 110 is activated by a thumping or hammer lever 115 located by the lower cushioned hand grip The thumping mechanism or arm 110 pivots about a pivot point 120 as activated by a control cable 125 that runs the length of the pole 55 on its exterior. A return spring 130 is located at the upper end of the pole 55 to automatically retract or withdraw the thumping mechanism 110, thus aiding the user 15 (as shown in FIG. 1) when performing the "thumping" action.

Figure 3:
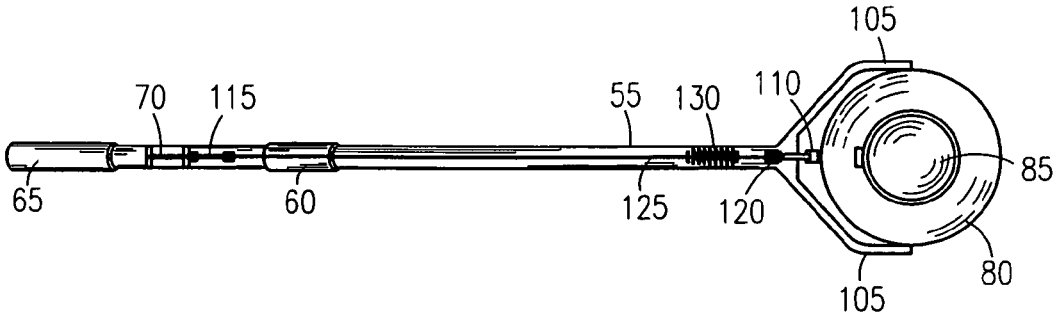
FIG. 3 is a front view of the deicing material dispensing system for gutters 10.

Referring now to FIG. 3, a front view of the deicing material dispensing system for gutters 10 is depicted. This view more clearly depicts the nature of the pole 55 and its relationship to the upper cushioned hand grip 60, the lower cushioned hand grip 65 and the deicing material reservoir 80. The thumping mechanism or hammer 110 hits or "thumps" the deicing material reservoir 80 directly in the center right below the reservoir lid 85, as pivoted around the pivot point 120, and operated around the thumping or hammer lever 115, the control cable 125 and the return spring 130. Such action is also directly over the deicing material slide gate 75 (as shown in FIG. 2) and as will be described in greater detail herein below, thus aiding in the removal of the deicing material 35 from the deicing material reservoir 80. The support arms 105, both visible in this FIG. are in physical contact with the deicing material reservoir 80. It is envisioned that the deicing material reservoir 80 would be made of plastic thus offering protection from the corroding effects of the deicing material 35. Other components of the deicing material dispensing system for gutters 10 such as the pole 55, the support arms 105 and the like would be made of rolled or stamped carbon steel for strength and painted for corrosion protection.

Figure 4:
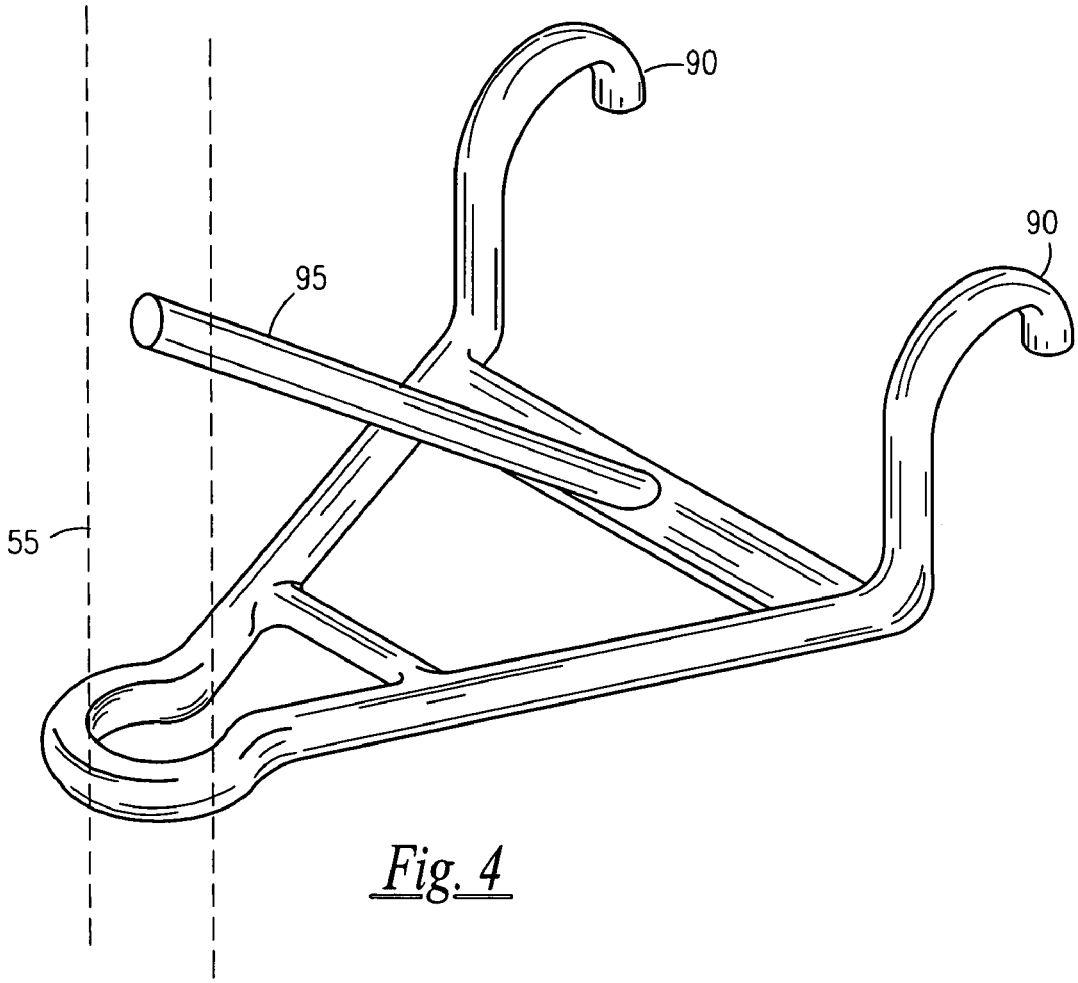
FIG. 4, is a detailed isometric of the aligning hook 90.

Referring next to FIG. 4, a detailed isometric of the aligning hook 90 is disclosed. This FIG. clearly depicts the dual nature of the aligning hook 90. Additionally, the support brace 95 and its relationship and interconnection to the pole 55 is shown.

Figure 5:
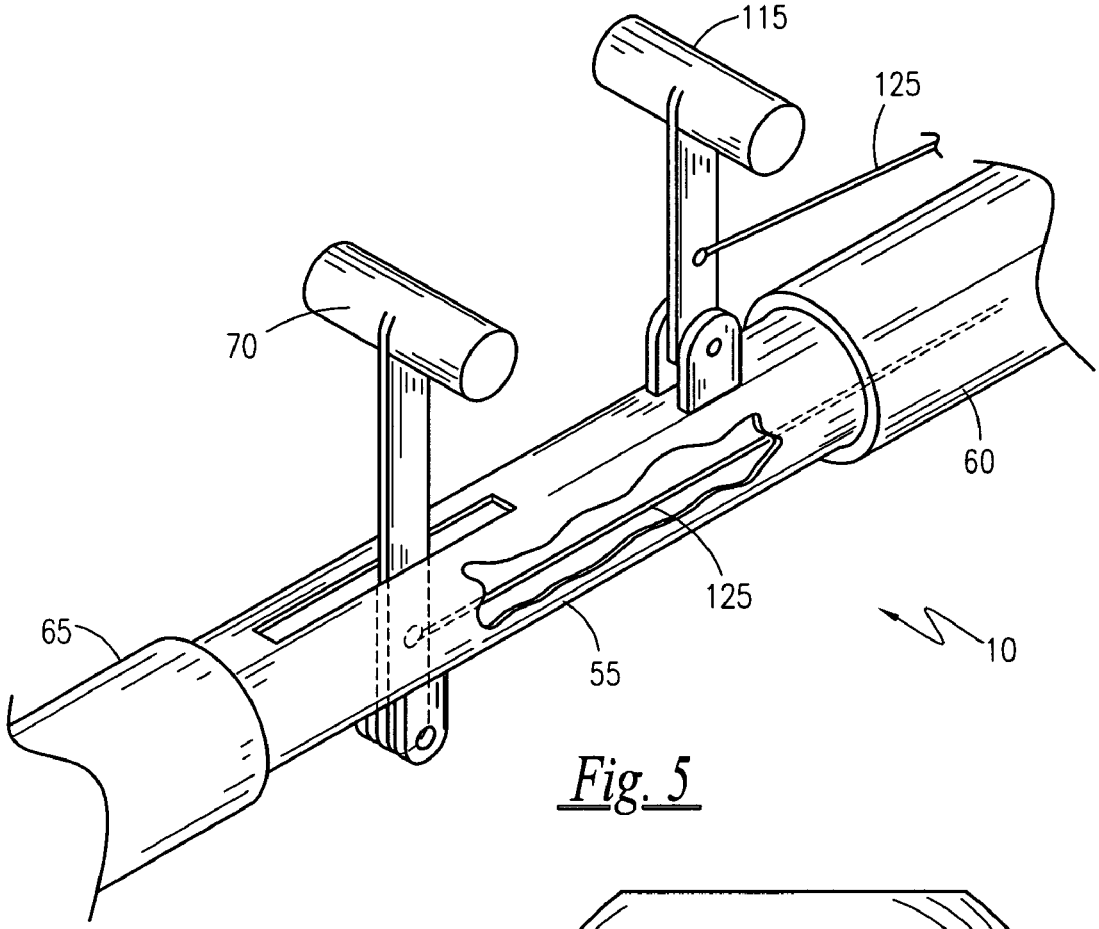
FIG. 5, is a detailed plan view of the lower end of the deicing material dispensing system for gutters 10; and, FIG. 6 is a detailed side view of the deicing material dispensing system for gutters 10.

Referring now to FIG. 5, a detailed plan view of the lower end of the deicing material dispensing system for gutters 10 is shown. This FIG. clearly shows the relationship between the upper cushioned hand grip 60 and the lower cushioned hand grip 65. Additionally, the relationship between the deicing material release lever 70 and the thumping or hammer lever 115 is depicted as well. Finally, a cutaway view inside the pole 55 shows the control cable 125.

Figure 6:
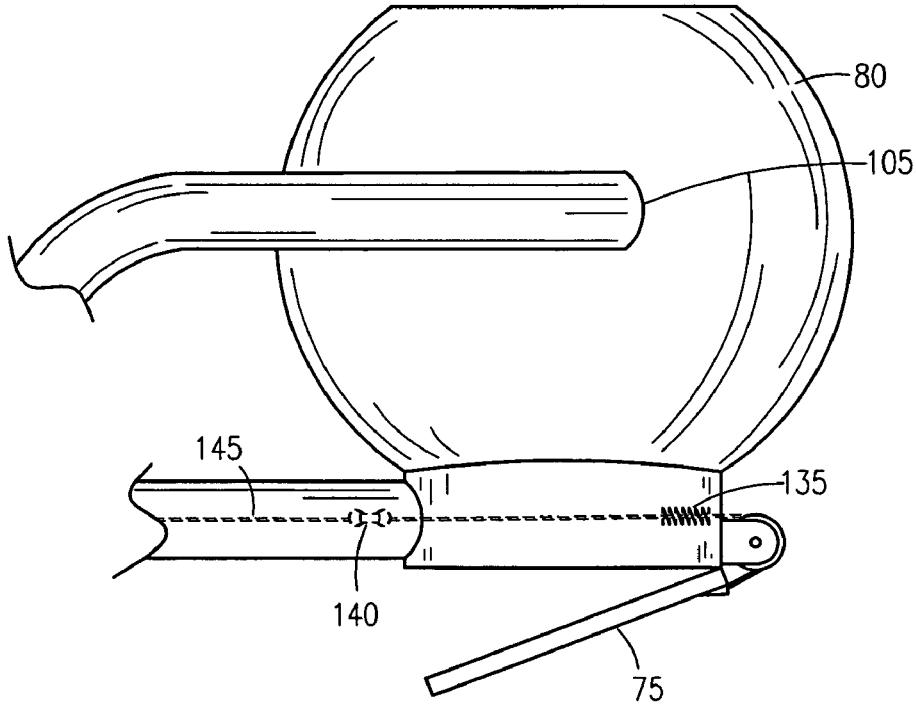

Referring finally to FIG. 6, a detailed side view of the deicing material dispensing system for gutters 10, as seen along a line I—I in FIG. 2 is disclosed. This FIG. shows the deicing material slide gate 75 in a partially retracted state on the bottom of the deicing material reservoir 80. Such retraction depicts a hole array or plurality of holes 135 on the bottom of the deicing material reservoir 80, through which the deicing material 35 (not shown in this FIG.) will emerge, in much the same manner as a salt shaker. This FIG. also clarifies the use of the support arms 105 in securing the deicing material reservoir 80. The deicing material slide gate 75 is retracted with the aid of a connecting harness 140 and a connecting cable 145 which are located on the interior of the deicing material dispensing system for gutters 10, and thus depicted with hidden lines. The connecting cable 145 then connects to the deicing material release lever 70 as shown in FIG. 1.

It is envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

The preferred embodiment of the present invention can be utilized by the common user in a simple and effortless manner with little or no training. After purchase or procurement of the deicing material dispensing system for gutters 10, it would be filled with deicing material 35, such as calcium chloride, rock salt, a fluid with a non-toxic an anti-freezing agent, or other common material that would not damage the roof or roof gutters 25 of the building 20. The user 15 would then begin at one end of the building 20 and hook the aligning hook 90 over the outward edge of roof gutter 100 to properly position it while holding the deicing material dispensing system for gutters 10 with the upper cushioned hand grip 60 and lower cushioned hand grip 65. Next, the user 15 would actuate the deicing material release lever 70, causing the deicing material slide gate 75 to open on the bottom of the deicing material reservoir 80 thus exposing the hole array 135. Gravity then would cause approximately eight to twelve ounces of the deicing material 35 to drop out onto the roof gutters 25. The user 15 would then release the deicing material release lever 70, ceasing the flow of deicing material 35 and move the deicing material dispensing system for gutters 10 to the next spot on the roof gutters 25 which would be approximately four to five feet.

In the event that the deicing material 35 clumps inside of the deicing material reservoir 80, the user 15 may activate the thumping or hammer lever 115 causing the thumping or hammer mechanism 110 to tap or "thump" the side of the deicing material reservoir 80 causing the deicing material 35 to dislodge. The thumping or hammer lever 115 accomplishes this with the aid of the pivot point 120, the control cable 125 and the return spring 130.

When finished, the user would rinse out the deicing material reservoir 80 with water, allowing it to air dry thus preparing it for use the next time it may be required.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. An apparatus dispensing de-icing material comprising:

a linearly elongated pole;

a reservoir storing and selectively releasing said de-icing material via a plurality of holes formed in said reservoir;

a release lever operatively coupled to a gate via an internal cable, said gate prohibiting egress of said de-icing material, said lever opening said gate and allowing egress of said de-icing material through said plurality of holes;

a lid on said reservoir permitting access to said reservoir; and a hook supported at an end of said pole, said hook rests upon an outer edge of a gutter, thereby properly aligned said apparatus with the gutter to dispense said de-icing material into the gutter;

and a hammer externally affixed to said reservoir to disperse aggregated de-icing material that may form in said reservoir.

2. The apparatus of claim 1, wherein said hammer is activated by a hammer lever affixed to said pole.

3. The apparatus of claim 2, wherein said hammer lever is operatively coupled to said hammer via an external control cable.

4. The apparatus of claim 3, wherein a return spring is operatively coupled to said external control cable acting to retract said external control cable after release of said hammer lever.

5. The apparatus of claim 1, wherein said de-icing material comprises calcium chloride.

6. The apparatus of claim 1, wherein said de-icing material comprises rock salt.

7. The apparatus of claim 1, wherein said de-icing material comprises a fluid having a non-toxic anti-freezing agent.

8. The apparatus of claim 1, wherein said pole has a pair of cushioned hand grips.

9. The apparatus of claim 1, wherein said internal cable reciprocates about two pulleys positioned on said pole.

10. The apparatus of claim 1, wherein said gate is retracted by a connecting cable releasing a connecting harness, said connecting cable coupled with said internal cable and said lever.

11. The apparatus of claim 1, wherein said reservoir is attached to said pole via a pair of support arms.

* * * * *